US011661819B2

(12) United States Patent
Brown et al.

(10) Patent No.: US 11,661,819 B2
(45) Date of Patent: May 30, 2023

(54) VALVE, METHOD AND SYSTEM

(71) Applicants: Donavan Brown, Houston, TX (US); Stephen Bisset, Porter, TX (US)

(72) Inventors: Donavan Brown, Houston, TX (US); Stephen Bisset, Porter, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/392,770

(22) Filed: Aug. 3, 2021

(65) Prior Publication Data

US 2023/0041355 A1 Feb. 9, 2023

(51) Int. Cl.

| | |
|---|---|
| ***E21B 34/10*** | (2006.01) |
| ***E21B 34/08*** | (2006.01) |
| ***E21B 34/14*** | (2006.01) |

(52) U.S. Cl.

CPC ..... *E21B 34/10* (2013.01); *E21B 34/08* (2013.01); *E21B 34/14* (2013.01)

(58) Field of Classification Search

CPC ..... E21B 2200/06; E21B 34/10; E21B 34/08; E21B 34/101; E21B 34/14; E21B 34/16; F16K 31/1221

See application file for complete search history.

(56) References Cited

U.S. PATENT DOCUMENTS

| | | | | |
|---|---|---|---|---|
| 1,619,328 A * | 3/1927 | Benckenstein | E21B 27/00 | 175/239 |
| 4,050,516 A * | 9/1977 | Canterbury | E21B 43/25 | 166/305.1 |
| RE30,115 E * | 10/1979 | Herd | F16K 31/1225 | 251/327 |
| 4,497,338 A | 2/1985 | Baker | | |
| 4,834,983 A | 5/1989 | Leitko, Jr. et al. | | |
| 6,427,773 B1 * | 8/2002 | Albers | E21B 34/103 | 166/185 |
| 7,357,198 B2 * | 4/2008 | Mcgarian | E21B 21/103 | 175/215 |

(Continued)

FOREIGN PATENT DOCUMENTS

JP 6088124 B2 3/2017

OTHER PUBLICATIONS

Notification of Transmittal of the International Search Report and Written Opinion; PCT/US2022/074473; Korean Intellectual Property Office; dated Nov. 22, 2022; 11 pages.

*Primary Examiner* — Kenneth L Thompson
(74) *Attorney, Agent, or Firm* — Cantor Colburn LLP

(57) ABSTRACT

A valve including a housing having an inlet and an outlet, a piston disposed in the housing, the piston having a first end and a second end, the piston movable between a position blocking fluid flow between the inlet and the outlet and a position allowing fluid flow between the inlet and the outlet, a pressure balance pathway through the housing porting the same pressure to both first and second ends of the piston, an actuator responsive to applied pressure on the valve, the actuator attached to the piston and a biasing arrangement configured to bias the actuator toward a closed position of the valve. A method for injecting a sequestration fluid including maintaining the fluid at a supercritical phase upstream of a valve, opening the valve by increasing pressure of the fluid, delaying phase change of the fluid from supercritical to gas.

16 Claims, 6 Drawing Sheets

(56) References Cited

U.S. PATENT DOCUMENTS

| | | | | |
|---|---|---|---|---|
| 9,163,489 | B2 * | 10/2015 | Cawley | E21B 43/164 |
| 10,060,210 | B2 * | 8/2018 | Braekke | E21B 21/103 |
| 2012/0255740 | A1 | 10/2012 | Fripp et al. | |
| 2019/0195048 | A1 | 6/2019 | Tveranger | |
| 2022/0333460 | A1 * | 10/2022 | Fripp | E21B 34/101 |

* cited by examiner

VALVE, METHOD AND SYSTEM

BACKGROUND

In the fluid sequestration industry it is desirable to maintain fluids such as Carbon Dioxide and Hydrogen in the supercritical phase prior to injecting them into a formation for safekeeping. There are operational benefits to maintaining the fluid in the supercritical phase but there are also detriments to do so since valves associated with the injection of the supercritical fluid into the formation tend to be damaged more than they would if the fluid were not supercritical. Damage is synonymous with cost and delay in the industry and hence is to be avoided. Therefore, the art will well receive alternative configurations and methods that reduce cost and increase efficiency.

SUMMARY

An embodiment of a valve including a housing having an inlet and an outlet, a piston disposed in the housing, the piston having a first end and a second end, the piston movable between a position blocking fluid flow between the inlet and the outlet and a position allowing fluid flow between the inlet and the outlet, a pressure balance pathway through the housing porting the same pressure to both first and second ends of the piston, an actuator responsive to applied pressure on the valve, the actuator attached to the piston and a biasing arrangement configured to bias the actuator toward a closed position of the valve.

A method for injecting a sequestration fluid including maintaining the fluid at a supercritical phase upstream of a valve, opening the valve by increasing pressure of the fluid, delaying phase change of the fluid from supercritical to gas until the fluid in which phase change is taking place is downstream of the valve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
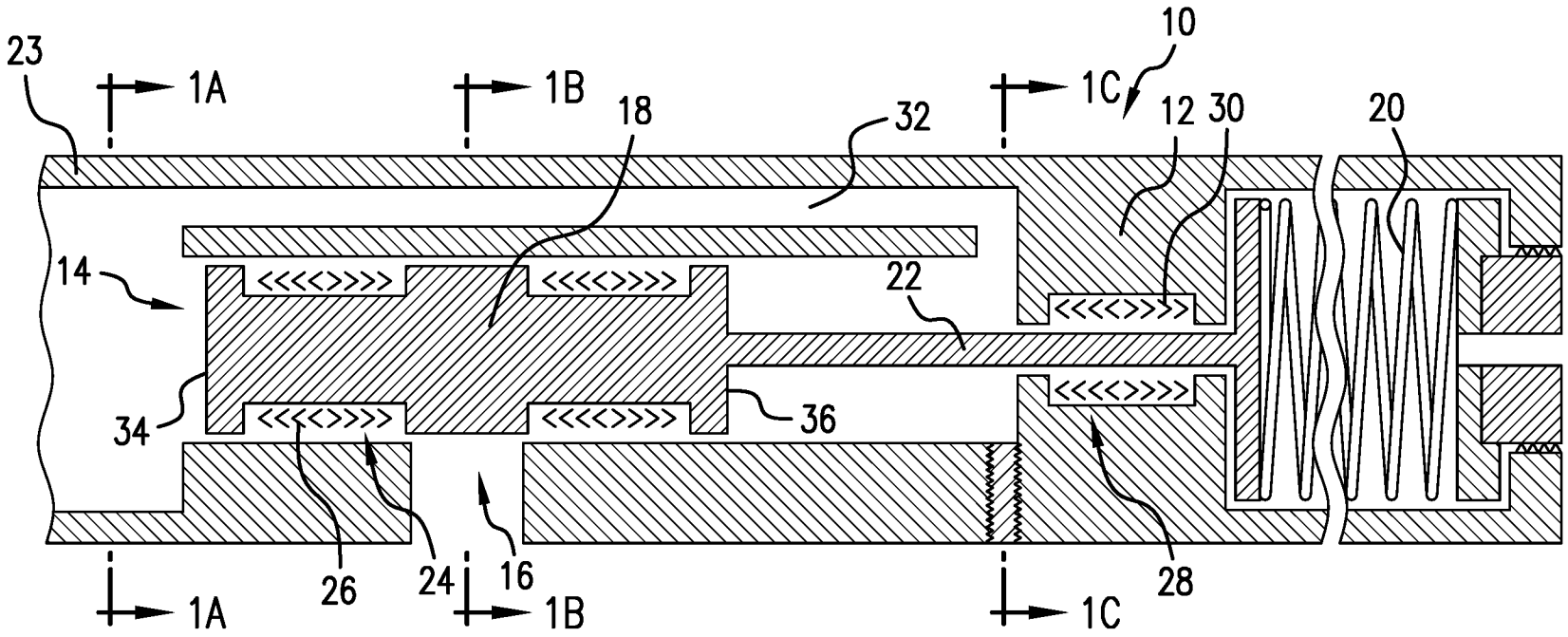
FIG. 1 is a sectional view of a valve as disclosed herein in a valve closed position.
Figure 1A:
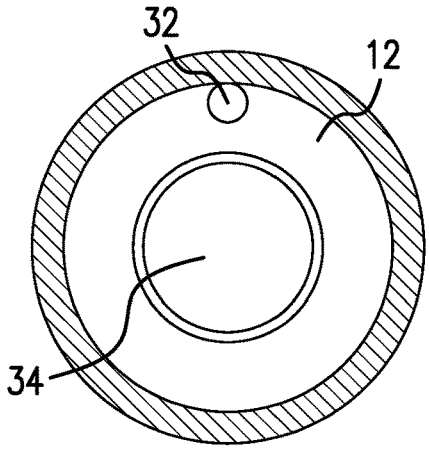
FIG. 1A is a section view of the valve in FIG. 1 taken along section line A-A in FIG. 1.
Figure 1B:
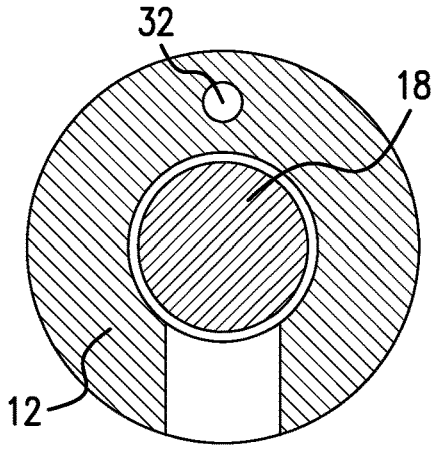
FIG. 1B is a section view of the valve in FIG. 1 taken along section line B-B FIG. 1.
Figure 1C:
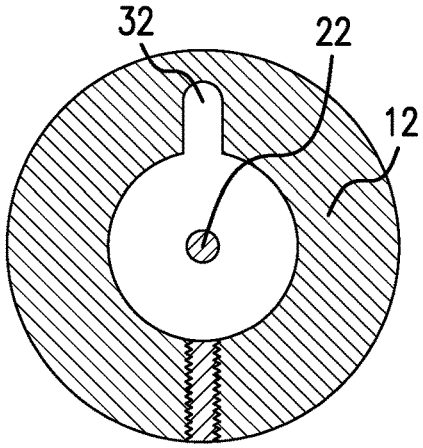
FIG. 1C is a section view of the valve in FIG. 1 taken along section line C-C FIG. 1.

Referring to FIGS. 1-1C, a valve 10 is illustrated. The valve 10 includes a housing 12 having a fluid inlet 14 and a fluid outlet 16. A piston 18 is movably disposed within the housing 12. A biasing arrangement 20 is in operable communication with the piston 18 through an actuator 22. The biasing arrangement is configured to bias the actuator 22, and thereby the piston 18, to a position wherein the valve 10 is closed. The biasing arrangement 20 maintains the valve 10 in the closed position absent the application of a threshold pressure applied to open the valve 10. It will be appreciated from FIG. 1 that a seal area 24 defined by piston seal 26 has a diameter that is significantly greater than a seal area 28 defined by actuator seal 30. In an embodiment, seal area 28 is no larger than half of seal area 24. The seal areas are important for actuation purposes, which will become evident in connection with the disclosure below.

The housing 12 includes a pressure balance pathway 32 that ports pressure from upstream of the valve 10 (to the left in the Figure) to both ends 34 and 36 of the piston 18. Equal pressure at both ends of piston 18 make the piston insensitive to applied pressure through a tubing string 23 or borehole tubular uphole of the valve 10. Since high flow rates are desired, which dictates a large piston 18 and therefore large seal areas, it will be appreciated that if the piston 18 were not pressure balanced, a very large spring force would be needed to keep the piston 18 in the closed position (FIG. 1) in the face of a large column of fluid in the string 23 uphole thereof. This is only exacerbated by the desire to manage the fluid to be sequestered in a supercritical phase (high pressure). All of the weight of the column, which may be thousands of feet long plus the pressure that fluid is under in order to remain in the supercritical phase must be counteracted by the bias arrangement if not for the following feature of this disclosure. The valve 10 avoids this issue by balancing the piston 18 and its large seal area 24 and configuring the valve with actuator 22 that is not balanced and has a much smaller seal area 28 upon which the pressure in the string 23 will act. The biasing arrangement 20 then may be much smaller or shorter or both since a much smaller counteractive force to that of the fluid to be sequestered acting only on a smaller seal area 28 is needed. Shorter springs mean shorter overall length for valves. Shorter valves are less unwieldy and more efficient, which makes them more desirable.

Figure 2:
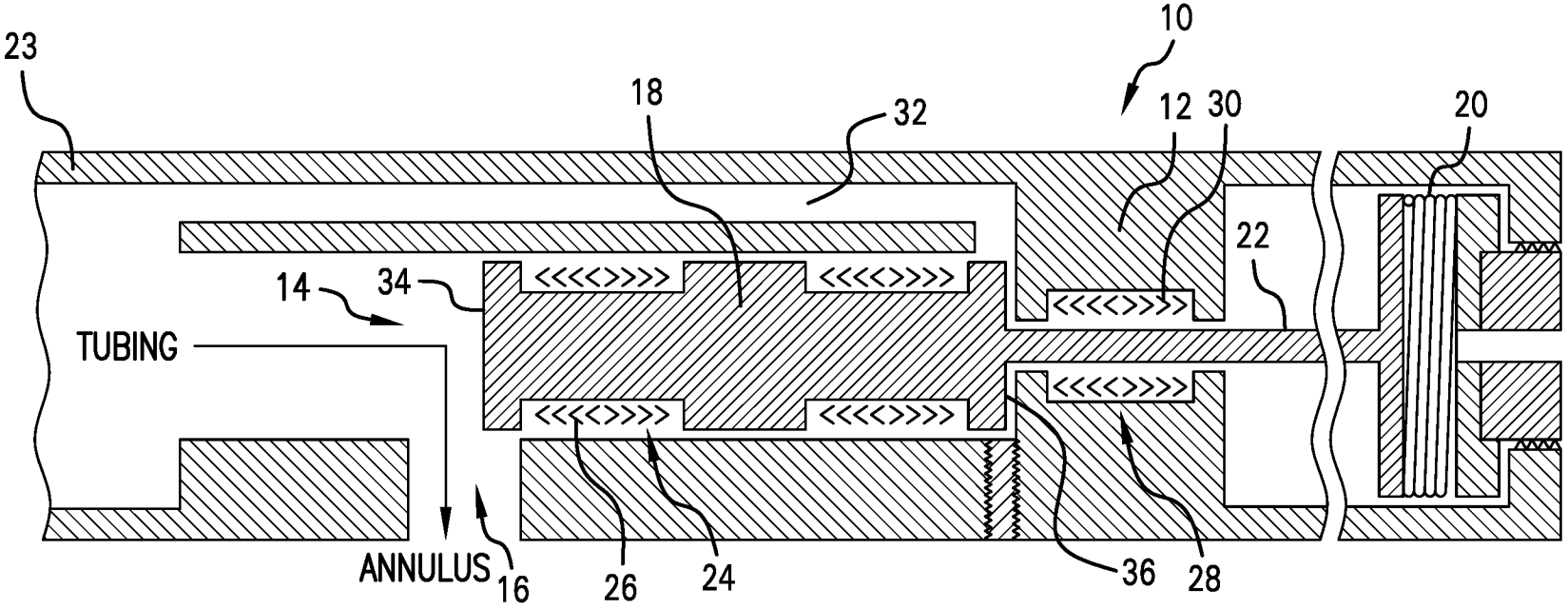
FIG. 2 is the same view as FIG. 1 in a flow position.

Upon applied pressure in the string, the actuator 22 is moved in a direction to compress the biasing arrangement 20. Upon movement of the actuator 22, the piston is moved with it. The movement of the piston 18 opens a flow path through the housing from the inlet 14 to the outlet 16. This position is illustrated in FIG. 2. Fluid in the string 23 may then be urged to a volume downstream of the outlet 16.

Figure 3:
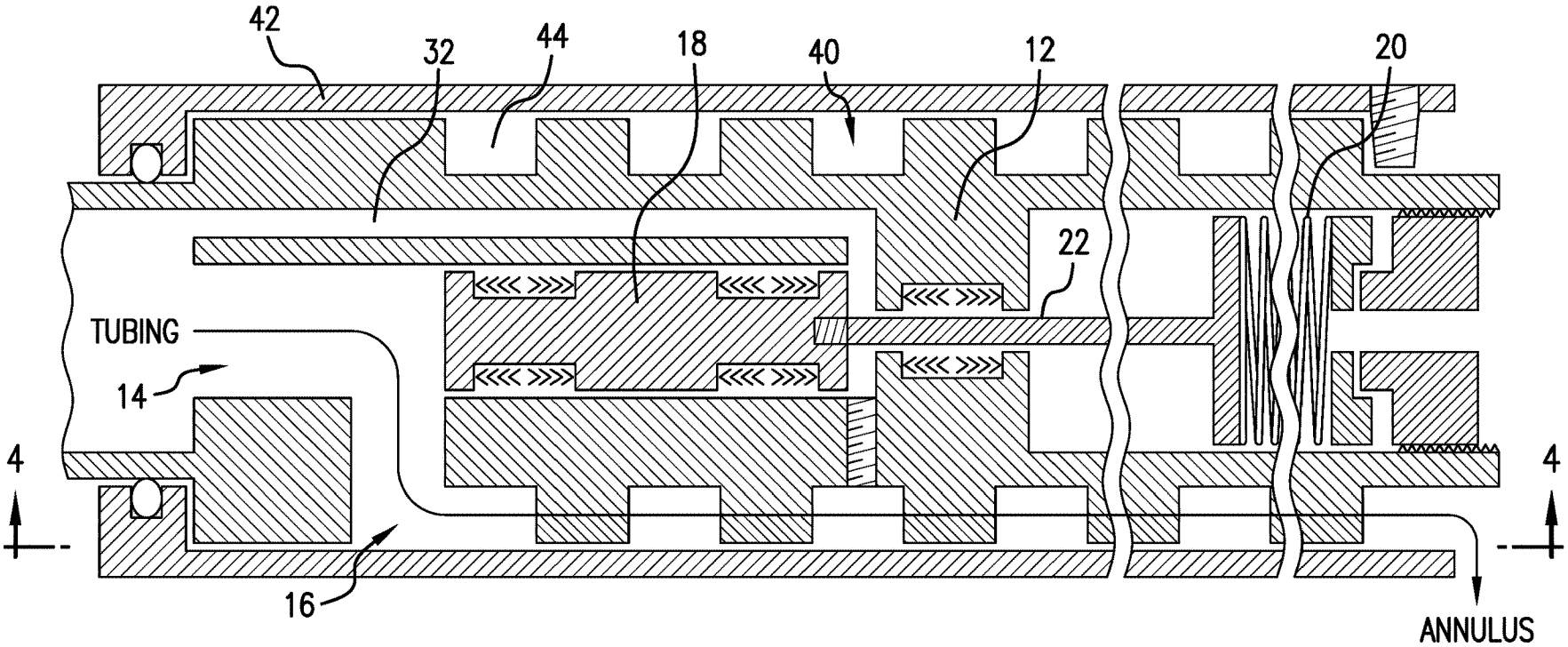
FIG. 3 is a sectional view of another embodiment of a valve as disclosed herein.

While the valve 10 may be employed in any fluid delivery system and benefit from the smaller required biasing arrangement force while maintaining a large flow path piston, the valve 10 is of particular value for supercritical fluid sequestration operations, especially when paired with a pressure reduction arrangement 40 (see FIG. 3).

Figure 4:
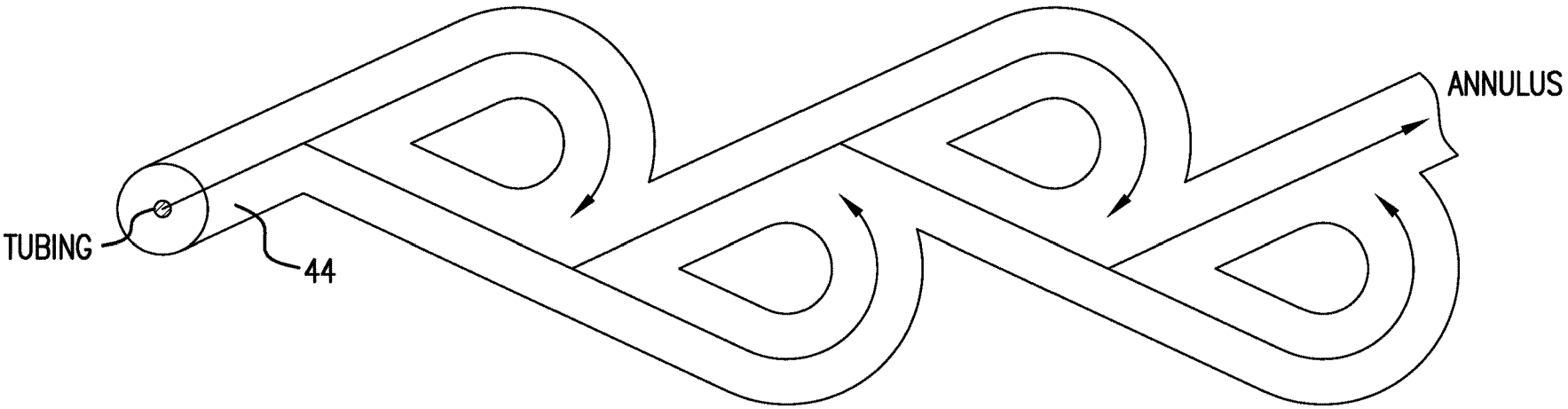
FIG. 4 is a view of a pressure drop configuration employed with the valve of FIG. 1 or 3.

Referring to FIG. 3, in one embodiment, the pressure reduction arrangement 40 is made a part of the housing 12 or is provided on an outside surface of the housing 12. If arrangement 40 is on an outside surface of housing 12, then a cover 42 may be disposed radially outwardly adjacent the arrangement 40 to provide for a flow pathway 44 that is enclosed. Arrangements that are within or on the surface of the housing 12 may include a tortuous path such as a zig zag, a maze, a spiral, etc. The pathway 44 may be configured as a fluidic diode as shown in FIG. 4 in some embodiments and in variations, the fluidic diode may be a Tesla diode. For arrangements on a surface of housing 12, standard of additive manufacture could be used. For arrangements that are made within a wall of the housing, and while it is still possible to use more traditional methods of manufacture, an additive manufacturing process would simplify the manufacture.

In each case, the pressure reduction arrangement 40 prevents a phase change of the sequestration fluid from a supercritical fluid to a gas until after that fluid has moved downstream of the valve 10. This greatly reduces wear on the valve such as erosion and thereby increases reliability and service life of the valve 10. The pressure reduction arrangement 40 must be close enough to the outlet 16 to prevent the phase change from supercritical to gas within the valve 10. Generally, this means that the arrangement 40 must be within a range of about zero feet to about 20 feet of the outlet 16. For example, supercritical Carbon Dioxide has a gradient of about 0.14-0.2 psi/ft (pounds per square inch per foot) at anticipated pressures/temperatures at which the valve 10 will be in service. Hence, for this sequestration fluid, up to about 20 feet distance between the valve 10 and the pressure reduction arrangement 40 will achieve the intent of maintaining the supercritical phase of the fluid with negligible pressure increase due to the fluid column in the string 23 and protecting the valve 10, by avoiding the undesirable phase changes in the supply string 23 and the valve 10.

Figure 5:
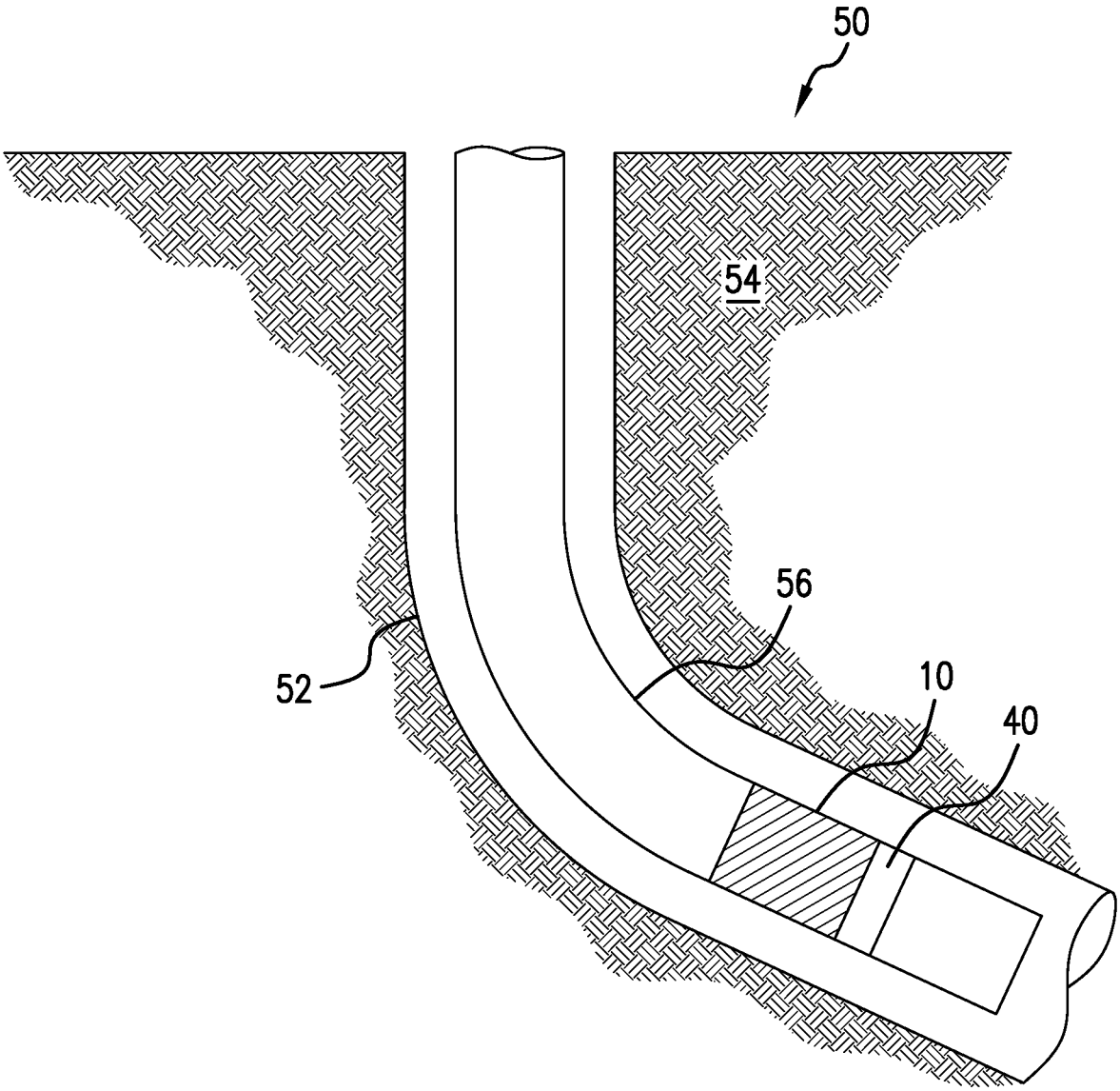
FIG. 5 is a view of a wellbore system including a valve embodiment disclosed herein.

Referring to FIG. 5, a wellbore system 50 is illustrated. The system 50 includes a borehole 52 in a subsurface formation 54. Disposed within the borehole 52 is a string 56. A valve 10 is disposed within or as a part of the string. Further a pressure reduction arrangement 40 is disposed downstream of the valve 10.

Set forth below are some embodiments of the foregoing disclosure:

Embodiment 1: A valve including a housing having an inlet and an outlet, a piston disposed in the housing, the piston having a first end and a second end, the piston movable between a position blocking fluid flow between the inlet and the outlet and a position allowing fluid flow between the inlet and the outlet, a pressure balance pathway through the housing porting the same pressure to both first and second ends of the piston, an actuator responsive to applied pressure on the valve, the actuator attached to the piston and a biasing arrangement configured to bias the actuator toward a closed position of the valve.

Embodiment 2: The valve as in any prior embodiment further including a seal area on the piston and a seal area on the actuator, the seal area on the actuator being smaller than the seal area on the piston.

Embodiment 3: The valve as in any prior embodiment, wherein the seal area on the actuator is no more than half the seal area on the piston.

Embodiment 4: The valve as in any prior embodiment, wherein the biasing arrangement is a spring.

Embodiment 5: The valve as in any prior embodiment, wherein the biasing arrangement is disposed in a recess in the housing.

Embodiment 6: The valve as in any prior embodiment further including a pressure reduction arrangement fluidically connected to the outlet.

Embodiment 7: The valve as in any prior embodiment, wherein the pressure reduction arrangement is a tortuous pathway.

Embodiment 8: The valve as in any prior embodiment, wherein the pressure reduction arrangement is a fluidic diode.

Embodiment 9: The valve as in any prior embodiment, wherein the fluidic diode is a Tesla diode.

Embodiment 10: The valve as in any prior embodiment, wherein the pressure reduction arrangement is disposed in and/or around the housing.

Embodiment 11: The valve as in any prior embodiment further including a cover that encloses a fluid pathway of the pressure reduction arrangement configured at an outside surface of the housing.

Embodiment 12: A method for injecting a sequestration fluid including maintaining the fluid at a supercritical phase upstream of a valve, opening the valve by increasing pressure of the fluid, delaying phase change of the fluid from supercritical to gas until the fluid in which phase change is taking place is downstream of the valve.

Embodiment 13: The method as in any prior embodiment, wherein the delaying is by flowing the supercritical fluid through a pressure reduction arrangement downstream of the valve.

Embodiment 14: The method as in any prior embodiment, wherein the pressure reduction arrangement is immediately fluidically downstream adjacent an outlet of the valve.

Embodiment 15: A wellbore system including a borehole in a subsurface formation, a string in the borehole, a valve as in any prior embodiment disposed in or as a part of the string.

Embodiment 16: A wellbore system as in any prior embodiment further including a pressure reduction arrangement fluidically connected to the outlet.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A valve comprising:

a housing having an inlet and an outlet;

a piston having a piston seal area disposed in the housing, the piston having a first end and a second end, the piston movable between a position blocking fluid flow between the inlet and the outlet and a position allowing fluid flow between the inlet and the outlet;

a pressure balance pathway through the housing porting the same pressure to both first and second ends of the piston;

an actuator, the actuator responsible for movement of the piston independent of the piston seal area, the actuator responsive to applied pressure on the valve, the actuator attached to the piston; and a biasing arrangement configured to bias the actuator toward a closed position of the valve.

2. The valve as claimed in claim 1 further including a seal area on the actuator, the seal area on the actuator being smaller than the seal area on the piston.

3. The valve as claimed in claim 2, wherein the seal area on the actuator is no more than half the seal area on the piston.

4. The valve as claimed in claim 1, wherein the biasing arrangement is a spring.

5. The valve as claimed in claim 1, wherein the biasing arrangement is disposed in a recess in the housing.

6. The valve as claimed in claim 1 further including a pressure reduction arrangement fluidically connected to the outlet.

7. The valve as claimed in claim 6, wherein the pressure reduction arrangement is a tortuous pathway.

8. The valve as claimed in claim 6, wherein the pressure reduction arrangement is a fluidic diode.

9. The valve as claimed in claim 8, wherein the fluidic diode is a Tesla diode.

10. The valve as claimed in claim 6, wherein the pressure reduction arrangement is disposed in and/or around the housing.

11. The valve as claimed in claim 6 further including a cover that encloses a fluid pathway of the pressure reduction arrangement configured at an outside surface of the housing.

12. A method for injecting a sequestration fluid comprising:

maintaining the fluid at a supercritical phase upstream of the valve as claimed in claim 1;

opening the valve by increasing pressure of the fluid;

delaying phase change of the fluid from supercritical to gas until the fluid in which phase change is taking place is downstream of the valve.

13. The method as claimed in claim 12, wherein the delaying is by flowing the supercritical fluid through a pressure reduction arrangement downstream of the valve.

14. The method as claimed in claim 13, wherein the pressure reduction arrangement is immediately fluidically downstream adjacent an outlet of the valve.

15. A wellbore system comprising:

a borehole in a subsurface formation;

a string in the borehole;

a valve as claimed in claim 1 disposed in or as a part of the string.

16. A wellbore system as claimed in claim 15 further including a pressure reduction arrangement fluidically connected to the outlet.

* * * * *